US006763693B1

(12) United States Patent
Gehrig et al.

(10) Patent No.: US 6,763,693 B1
(45) Date of Patent: Jul. 20, 2004

(54) METHOD FOR SHAPING AN INITIAL PROFILE OR A SIMILAR WORKPIECE USING AN INTERNAL HIGH PRESSURE AND PROFILE THEREFOR

(75) Inventors: Markus Gehrig, Schaffhausen (CH); Christian Leppin, Schaffhausen (CH); Pius Schwellinger, Tengen (DE)

(73) Assignee: Alcan Technology & Management Ltd. (CH)

( * ) Notice: Subject to any disclaimer, the term of this patent is extended or adjusted under 35 U.S.C. 154(b) by 0 days.

(21) Appl. No.: 10/049,097

(22) PCT Filed: Jul. 21, 2000

(86) PCT No.: PCT/CH00/00401

§ 371 (c)(1),
(2), (4) Date: Feb. 5, 2002

(87) PCT Pub. No.: WO01/10580

PCT Pub. Date: Feb. 15, 2001

(30) Foreign Application Priority Data

Aug. 5, 1999 (DE) ..... 199 36 501

(51) Int. Cl.[7] ..... B21D 26/02
(52) U.S. Cl. ..... 72/61; 72/370.22
(58) Field of Search ..... 72/60, 61, 370.22

(56) References Cited

U.S. PATENT DOCUMENTS 3,209,432 A * 10/1965 Cape ..... 72/177
5,339,667 A 8/1994 Shah et al.
6,112,567 A 9/2000 Birkert
6,151,940 A 11/2000 Amborn et al.

FOREIGN PATENT DOCUMENTS

| | | |
|---|---|---|
| DE | 34 32 499 | 11/1986 |
| DE | 42 14 557 | 11/1993 |
| DE | 198 03 738 | 8/1999 |
| DE | 198 13 012 | 10/1999 |

* cited by examiner

*Primary Examiner*—Lowell A. Larson
(74) *Attorney, Agent, or Firm*—Ostrolenk, Faber, Gerb & Soffen, LLP

(57) ABSTRACT

The invention relates to a method for shaping an initial profile (16*a*) or a similar workpiece, which comprises a profile space, into a final profile by using an internal high pressure that is generated in the sealed profile space by a flowable active medium. In order to shape the initial profile (16*a*) comprising at least one corner area (28*n*), preferably at least two corner area (28*n*), wall sections (34) which connect in the corner area (28*n*) are preshaped such that their cross-sections are curved counter to the direction of pressure, and are subsequently straightened by the internal high pressure of the flowable active medium while displacing the corner area (28*n*) in a direction of pressure. To this end, a profile comprising a profile space that is delimited by profile walls (22*n*) is used in which two profile walls (22*n*) define a corner area (28*n*) of the profile cross-section, whereby at least one of the profile walls (22*n*) connecting in the corner area (28*n*) is provided with an area (32) having a curved cross-section. A polygonal cross-section whose profile walls (22*n*) between the corner areas (28*n*) each comprise the inwardly curved area (32) or with which selected profile walls (22*n*) which connect two corner areas (28*n*) preferably offer a curved area (32).

15 Claims, 3 Drawing Sheets

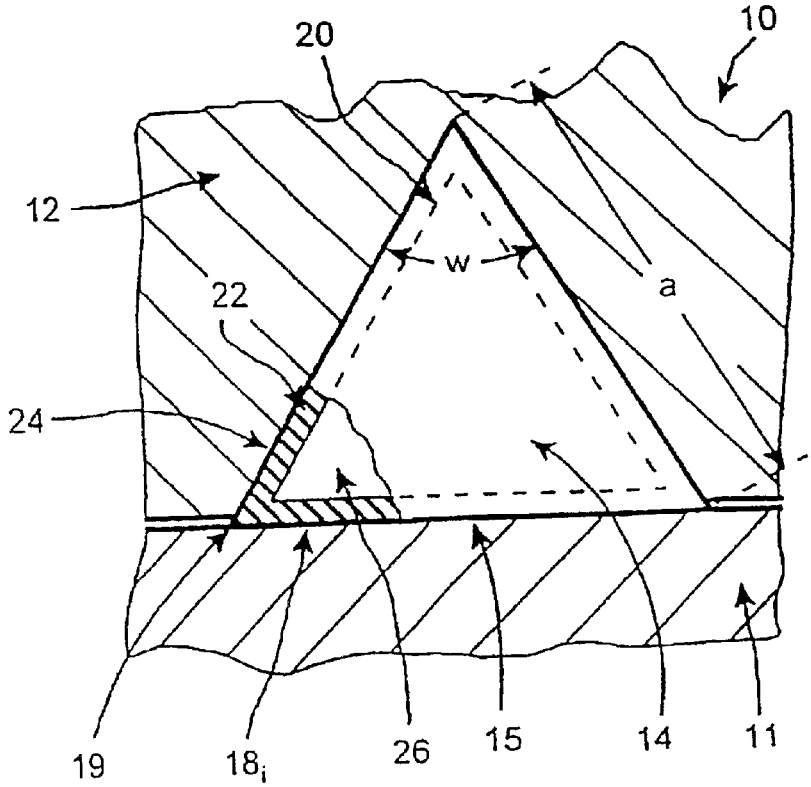
Fig.1
Fig.2
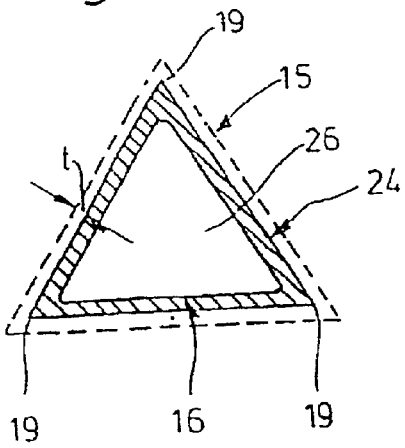
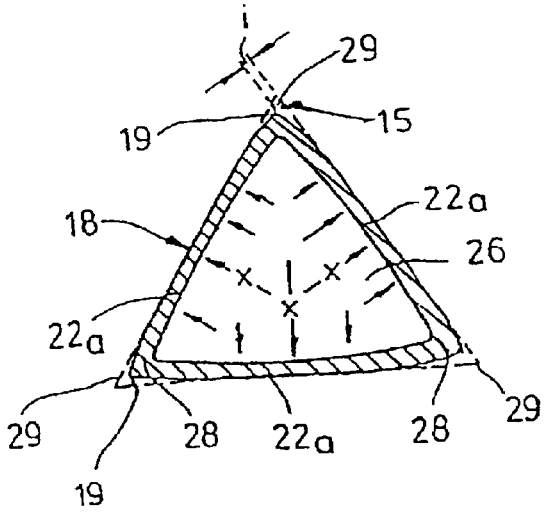
Fig.3

Fig.4
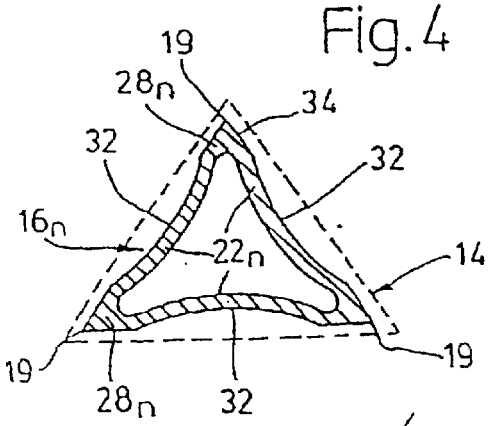
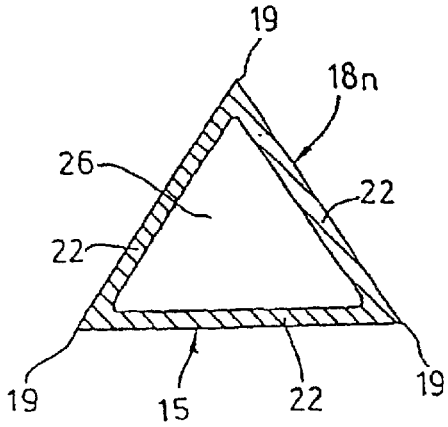
Fig.5
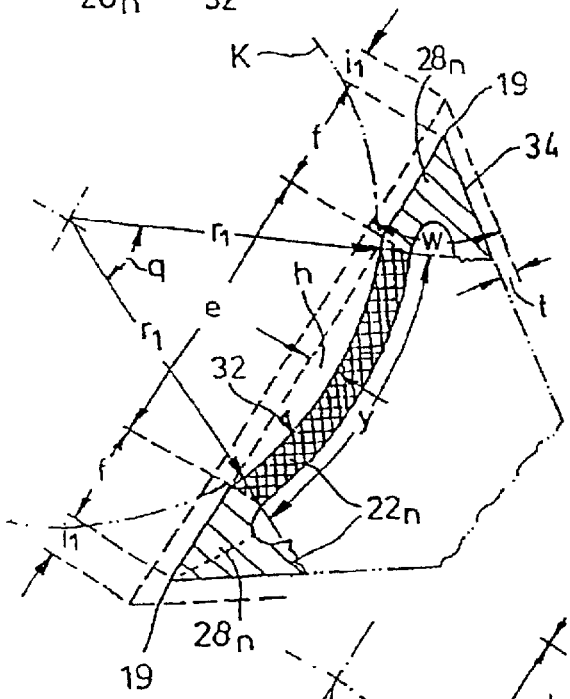
Fig.7
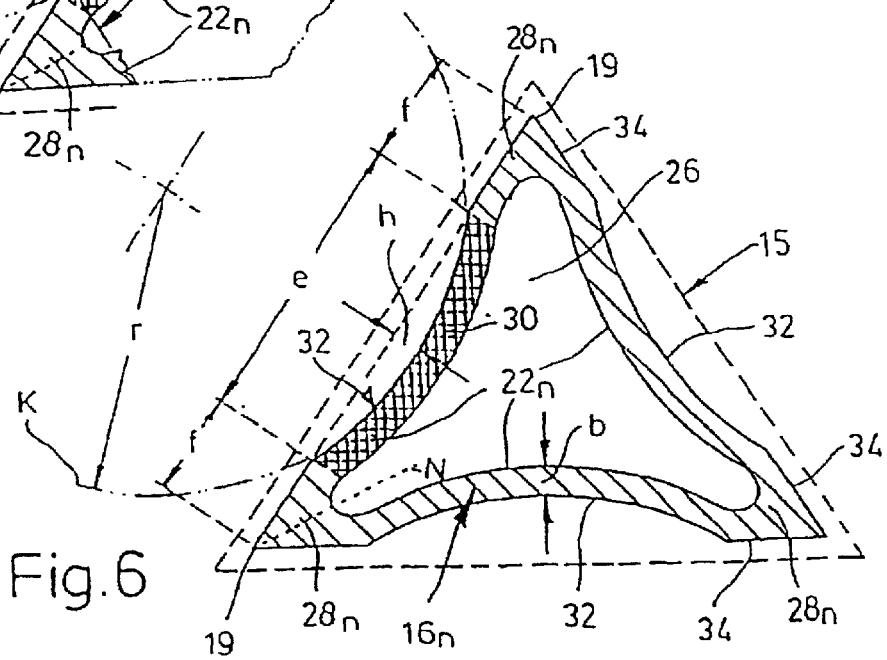
Fig.6

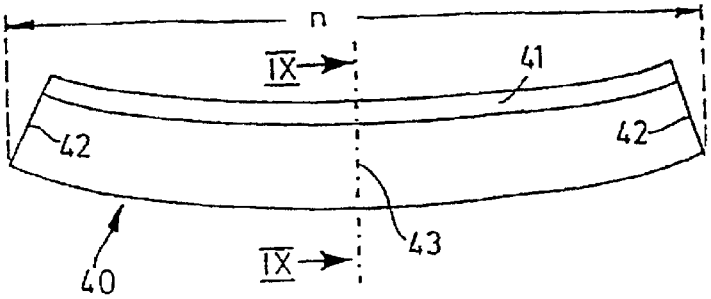
Fig.8
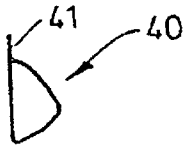
Fig.9
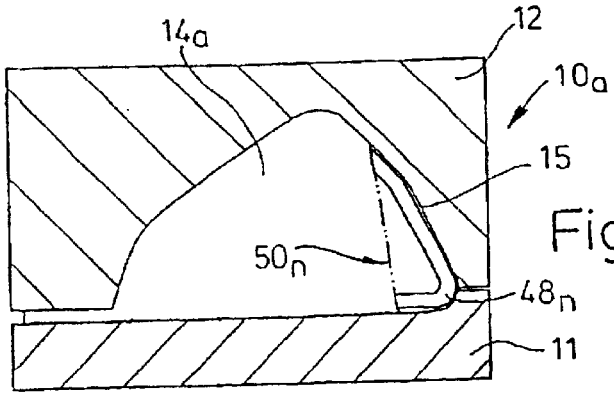
Fig.10
Fig.11
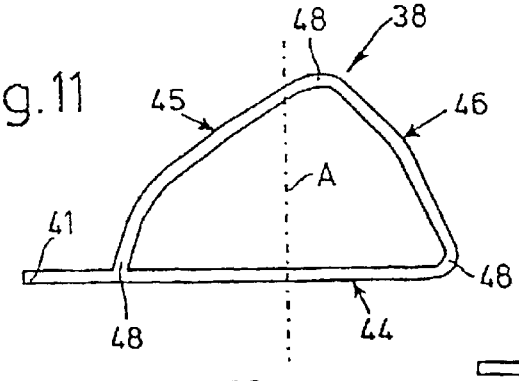
Fig.12
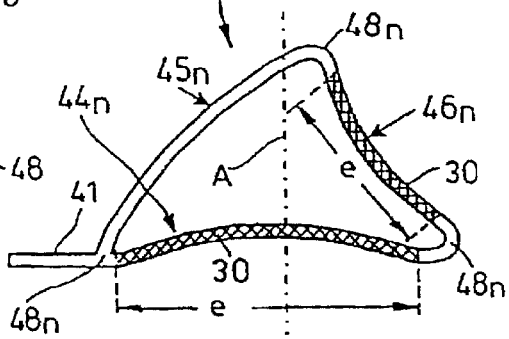
Fig.13
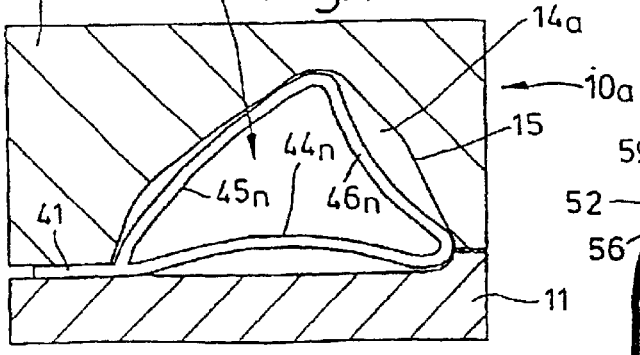
Fig.14
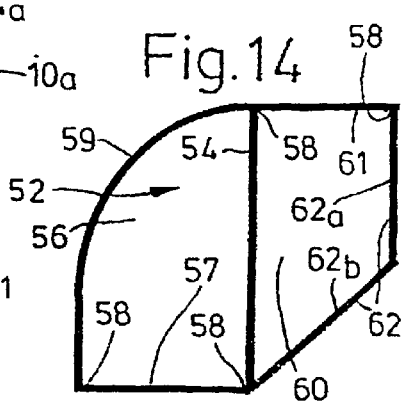

METHOD FOR SHAPING AN INITIAL PROFILE OR A SIMILAR WORKPIECE USING AN INTERNAL HIGH PRESSURE AND PROFILE THEREFOR

PRIORITY CLAIM

This is a U.S. national stage of application No. PCT/CH00/00401, filed on Jul. 21, 2000. Priority is claimed on that application and on the following applications:

Country: Germany, Application No.: 199 36 501.6, Filed: Aug. 5, 1999; and

Country: Germany, Application No.: 199 46 011.6, Filed: Sep. 25, 1999.

BACKGROUND OF THE INVENTION

The invention relates to a process for forming an initial section or like component featuring a hollow interior to a final shape by means of high internal pressure in the sealed hollow interior using a medium that can flow, in particular forming until the final section comes into contact with the wall of a shape-determining space. Further, the invention also relates to a section with a space delimited by section walls, in which two section walls each determine a corner region of the cross-section, in particular an initial section for carrying out this process.

In the high-internal-pressure-forming (HIPF) process a hollow section is expanded by means of internal pressure. In addition, by means of at least one stem engaging the part in question, the hollow section may be displaced and widened, compressed or expanded.

German Patent DE 35 32 499 C1 describes a device for hydraulic expansion of a length of pipe by using a plug-like cylindrical probe which can be introduced into the pipe and, using at least a pair of sealing rings spaced a distance apart, forms a circular space which is filled with compressive medium for the purpose of expanding the tube. Each of the sealing rings is situated in a ring-shaped grooved with a u-shaped in cross-section, in the probe and initially upon introducing the probe into the tube, has an outer diameter which at most is the same as the outer diameter of the probe. Before starting the expansion process, in order to seal the ring-shaped gap between the probe and the tube, compressive medium is introduced into the ring-shaped grooves via a feed pipe connected to the medium supply line and applies compressive force radially to the sealing rings. The feeding of the compressive medium to the ring-shaped space is performed solely by way of at least one of the grooves and is controlled by a sealing ring acting as a valve, which closes off an opening between the groove and the ring-shaped space until it has achieved its sealing function by elastic expansion. That groove is provided with at least one inclined slit at its edge neighboring the ring-shaped space. If the pressure in the ring-shaped space between the two seals is increased, the wall of the tube begins to expand in this region.

This internal high pressure forming or hydroforming process is finding ever increasing application in the automobile industry as an economical means for manufacturing car body components. Mainly steel tubes are employed as starting material. The final contour of the component to be shaped this way is generally much more complicated than the simple circular cross-section of the starting material. As a rule, the HIPF process results in regions which are much more heavily deformed than other regions and which are correspondingly thinner. If these regions are subjected to a high degree of loading in use, the initial sheet must be sufficiently thick; this however results in an unnecessary amount of material in the less heavily formed regions. This disadvantage is contrary to the requirement of obtaining the lowest possible weight in the component.

Recently aluminium alloys have been included along with steel as starting material for HIPF processes. As with steel there are manufacturing processes in which tubes of aluminium sheet are employed as starting material; alternatively, extruded aluminium sections may also be employed for that purpose. For economic reasons extruded steel sections do not come into question here. The use of extruded sections has the decisive advantage that the shape of the initial section is almost without limit.

HIPF processes using extruded sections are employed mainly to be able to produce high precision parts. To that end the present state of the art tends to make the shape of the initial section as close as possible to that of the final section in order to employ relatively small degrees of deformation in the HIPF-process. In particular with curved components that are to be bent in advance or where the section cross-sections feature sharp corners, this approach is usually not successful. Also, attempts to keep the degree of deformation small generally results in its non-uniform distribution. As a result—and due to the pre-shaping from the bending process—spring-back effects are produced causing the desired precision to be achieved only in exceptional cases using that process. Likewise as a rule, sharp corners which exhibit a large ratio of wall thickness to outer radius cannot be filled out using this process.

In HIPF-processes using steel pipes it is normal to carry out pre-shaping prior to the actual shaping process (bending and HIPF)—this e.g. in order to arrive at a more favourable cross-section for bending or in order to make it even possible to place the part in the HIPF shaping tool.

SUMMARY OF THE INVENTION

In view of the above, the object of the present invention is to provide a specific cross-section of an extruded section which achieves a favorable distribution of deformation in the HIPF-process; the elastic spring-back of the component after removal from the HIPF shaping tool should be minimized and dimensional accuracy achieved to the desired degree of precision.

In accordance with the present invention, in order to shape-form the initial section featuring at least one corner region, the wall sections adjacent to the corner region are pre-shaped in a curved manner—as viewed in cross-section—counter to the direction of applied pressure, and subsequently reshaped by applying the high internal pressure of the medium that can flow in the direction in which the pressure is applied, displacing the corner region. If there are at least two corner regions present, the wall lengths between the corner regions are accordingly pre-shaped counter to the direction in which the pressure is applied and reshaped—likewise by applying the high internal pressure of the medium that can flow, displacing the corner regions in the direction in which the pressure is applied.

In practice the reshaping will mainly concern angles that are almost right angles, whereby the section cross-sections need not have rectangular shaped contours. However, other sizes of angle can be reshaped, in particular corners running to a peak with angles of less than 45°.

It has been found favorable to carry out the displacement of the corner region in the direction of the line bisecting the angle or its line of symmetry. In the initial section this corner region should also be of greater thickness.

The local degree of deformation can be created in the initial section in the form of oversizing with respect to the final contour of the final section, this by means of a doming—inward pointing curvature in the section cross-section. It is also possible to introduce the degree of deformation in the initial section in the form of undersizing with respect to the final contour of the final section.

Usefully, therefore, the requirements for precise light weight construction are met i.e. the initial section is designed in such a manner that at the end of the HIPF process the component exhibits an accumulation of material mainly in those places where, for reason of strength, this is required. In order to achieve the above mentioned goals:

- the local degree of deformation of the section wall is controlled by curvature in the cross-section and by lengths of section with local undersizing and, in this connection, the internal stress oriented in the longitudinal direction;
- section corners are made more pointed;
- those lengths of section which should undergo little or no deformation are made thicker;
- section cross-sections are curved in advance.

Controlling the local degree of deformation by means of dome-like, inwards pointing curvature of the cross-section, and section lengths that are undersized locally, is achieved using the following principle.

The inwards pointing curvature of the cross-section is important here; especially with regard to cross-sections whose section walls are curved in the final component, it is emphasized that it depends on the relative curvature and not on the absolute curvature. This is so because in the end this determines whether the contour of the initial section—with respect to the final contour—exhibits oversizing or undersizing, through which the behavior of the component in the described shape-forming process is controlled.

By doming or similar cross-sectional curvature it is possible to achieve local oversizing. In contrast to domed oversizing on the outside of the section, this doming does not cause any problem on placing the component into the mold or on closing the mold. In the HIPF process the oversizing causes local compression of the material in the direction along the periphery of the section. As a result of the constant volume of aluminum, internal compressive stresses are created in the longitudinal direction of the section, which on removing the component from the mold results in corresponding spring-back in the longitudinal direction. By providing lengths of section with local undersizing, the material is made to stretch in the peripheral direction of the section at these places during the HIPF process. Due to the above mentioned plastic constant volume of aluminum, tensile stresses are induced in the longitudinal direction of the section, which on removing the component from the mold, results in corresponding spring-back in the longitudinal direction.

A suitable distribution of stretching and compressive zones minimizes the resultant overall spring-back, so that after the HIPF process the components obtained are accurate in shape.

In order to reshape sharp corners at the same time avoiding excessive local degrees of deformation at the corners, the following measures are taken:

- pronounced thickening of the section corners prevents irreversible bending at the start of the HIPF process;
- by providing dome-like curvature in the cross-section in the immediate vicinity of the thickened section corners it is possible to reduce, even completely eliminate, the local stretching of the material necessary to reshape small corner radii.

Within the scope of the invention is a hollow section featuring a space delimited by section walls where two section walls define each corner region of the section cross-section and at least one of the section walls adjacent to the comer region exhibits, as viewed in cross-section, a curved region. Preferred is a polygonal cross-section—in particular a triangle-shaped cross-section—the section walls of which exhibit an inward curved region between each of the comer regions; it is however also possible e.g. to provide only one single wall with a curved region. Usefully, the curved region of section wall should join up with corner regions at both ends. The cross-sectional shape of that curved region may be in the form of part of a circle or part of an ellipse, parabola shaped, hyperbola-like or have some other contour form.

It has been found favorable for such a bent region to exhibit a contour that is in the form of part of a circle, the arc length of which is defined as the distance between a pair of flanges that delimit the related corner regions. That distance is given by the length of section side wall less the lengths of the flanges in the related corner region—which, depending on the cross-sectional shape of the extrusion and the distribution of wall-thickness may also be unequal—and less the distance defined by the projection of the gap between the initial section and the contour of the shaping tool mold accommodating the component.

Usefully, the length of the flanges in the comer region of the initial section is three to four times the average wall thickness of the lengths of section walls adjacent to the corner region; the length of flange depends on the thickness of the section wall and on the angle these make at the comer region.

In the case of an initial section of cross-section in the form of an equilateral triangle, that distance between the flanges should be e.g. about three times the length of the flange. In this case the height of doming, i.e. the distance between the curvature in the form of part of a circle and a straight line joining the flanges, should correspond approximately to the thick-ness of the section wall.

When using extruded aluminum sections it is possible to avoid the work step involving pre-forming of the sections in that the initial section is manufactured in the desired favorable pre-bent shape. Apart from the savings associated with the pre-forming, at the same time a high degree of process reliability is achieved on bending or on closing the HIPF shaping tool.

BRIEF DESCRIPTION OF THE DRAWINGS

Further advantages, features and details of the invention are revealed in the following description of preferred exemplified embodiments and with the aid of the drawing which shows schematically in:

FIG. 1: a part of a shaping tool shown in cross-section with optimally shaped section cross-section in a tool opening after an HIPF step;

FIG. 2: cross-section through an initial section according to the state-of-the-art within a tool contour—indicated by broken lines—before an HIPF step;

FIG. 3: the section in FIG. 2 after forming;

FIGS. 4, 6: cross-section through an extruded initial section according to the invention and tool contour (shown enlarged in FIG. 6);

FIG. 5: the section in FIG. 4 after forming;

FIG. 7: a detailed sketch of part of FIG. 6;

FIG. 8: an extrusion frame shown in plan view;

FIG. 9: cross-section through FIG. 8 along line IX—IX;

FIG. 10: cross-section of the shaping tool employed to produce the final contour of the section frame;

FIG. 11: cross-section through an initial section for the section frame according to the state-of-the-art;

FIG. 12: cross-section through the initial section according to the invention;

FIG. 13: the initial section in FIG. 12 inside the shaping tool shown in cross-section;

FIG. 14: the cross-section of another section.

DETAILED DESCRIPTION OF THE PREFERRED EMBODIMENTS;

As shown in FIG. 1 a shaping tool 10 comprising a base part 11 and an upper part 12 features an interior space 14 with walls 15 in the form of an equilateral triangle with angles w of 60° and side lengths a; inside the tool 10 is a desired, ideal hollow section $\mathbf{18}_i$ indicated by the inner contour 20 of its three walls 22; the outer contours 24 are coincident with the walls 15 of the tool 10.

In order to create a hollow section as the final section 18, an initial section—for example the initial section 16 shown in FIG. 2—of narrower cross-section is introduced into the space 14. The outer contour 24 of this section 16 according to the state of the art in FIG. 2 corresponds to that of an equilateral triangle and stands an approximately equal distance t from the wall or wall contour 15. The initial section 16 is then expanded until it meets that wall contour 15 using the high internal pressure forming process (HIFP) in which—as shown in FIG. 3—a fluid medium creates a high pressure in the direction shown by the arrows x in the interior 26 of the starting section 16.

After the HIFP-shaping step, the result is a hollow section 18 of larger cross-section; the middle region of the wall contour 24 of the section walls $\mathbf{22}_a$, as shown in FIG. 3, lie against the walls 15 of the shaping tool; towards the section corners 19, however, the corner regions 28 of the hollow section 18 maintain a distance i from the walls—the distance i increasing the closer to the corner and forming an angular space 29 whose flanges taper away from the corner of the wall contour 15 i.e. the corner is not filled out.

In order to avoid such undesirable shaping and to obtain, by means of HIFP-shaping, a final or hollow section 18*a* as shown in FIG. 5 that corresponds to the ideal hollow section $\mathbf{18}_i$, an initial section $\mathbf{16}_n$ according to FIG. 4 is extruded with section walls $\mathbf{22}_n$ that, in cross-section, are curved inwards as a part of a circle over a central region 30 of length e (indicated in FIGS. 6, 7 by cross-hatched lines); the radius r of curvature K of the outer surface 32 of the curved region 30 corresponds approximately to length e. In FIG. 6 for reason of clarity the curvature K is extended beyond the section wall $\mathbf{22}_n$. Running from the corners 19 of the section on both sides are linear wall sections of lengths f as flanges of the corner angle w of 120° or of the corner regions $\mathbf{28}_n$ which are thicker than the wall thickness b. The distance between the corner regions $\mathbf{28}_n$—defined by the flanges 34—defines the arc length of the curvature K or the above mentioned length e and measures here approximately three times the length f of the flanges 34. The magnitude h of the crown formed by the curved outer contour or outer surface 32 of the section wall $\mathbf{22}_n$ corresponds approximately to the wall thickness b, or is slightly larger. As a result of the radius of the leveling of the curved lengths 30 of section walls $\mathbf{22}_n$ the high internal pressure pushes the described corner regions $\mathbf{28}_n$ of angle w into the corresponding corner of the mold, with the result that the angular spaces 29 in the mold in the example shown in FIG. 3 are avoided. The corners are pushed in the directions determined by the corner middle lines N.

For reasons of clarity it should be pointed out that requirement of the height h of the crown to be approximately the same as the thickness b of the wall applies only to the example chosen here; essential for the shape of the curvature K is its length or length of arc y (FIG. 7). The arc length y determines whether the length of section wall $\mathbf{22}_n$ in question is greater or smaller than the length of sidewall a. If for example the length in question is to be greater by an amount u (if it is smaller, then u is negative), then the arc length must be as follows $$y=e+2i_1+u/2 \tag{1}$$

where $i_1$ is a distance from the corner derived from the associated angle w and the local gap t according to the following relationship $$i_1=t^*\tan(w/2). \tag{2}$$

Further, taking into account the length of flange f:

$$e=a-2(f+i_1) \tag{3}$$

Depending on the type of curvature K, the height of crown h is a function of the length of arc y—indicated in FIG. 7. If K is a part of a circle, then—taking into account the angle of arc q formed by the radii $r_1$ of the curved region 30—in addition to equation (1), the following equations may be used to determine the height of crown h:

$$h=r_1(1-\cos(q/2)) \tag{4}$$

$$e/2=r_1\sin(q/2) \tag{5}$$

The height of crown h can be determined with the aid of an iteration method. Also, when designing a cross-section of an extrusion in practice using a CAD program, the length of arc y of a curve is known and can be easily adjusted in order to arrive at the desired dimension.

The example discussed here is used in the following to demonstrate the filling out of sharp corner regions. The exact geometry of the part cross-section is not binding; it may also be a rectangular cross-section or a completely different—also irregular—geometry. In addition, as already mentioned, it is not necessary for the curvature K to be an arc of a circle; it is also possible to employ ellipses, parabolas, hyperbolas, splines or some other shape of curve.

A section frame 40 shown in the form of a sketch in FIGS. 8, 9 is slightly curved along its length n of e.g. approximately 2000 mm and features a strut 41 at its side. At its ends 42 and in the middle region 43 the section frame 40 is welded to other components which are not shown here. In order to be able to employ a laser welding method, it is necessary to specify a tolerance of approx ±0.5 mm for the line of bending. Also the section frame 40 is made out of an aluminum extrusion which is first bent and then given its final shape in an HIPF process.

The contour 15 of the mold space 14*a* in the HIPF tool 10*a* in FIG. 10 corresponds exactly to the desired outer contour of the finished section frame 40. The bending process is chosen such that the slight curvature in the section frame 40 due to the change in cross-section resulting from the bending process can be neglected.

Up to now, as FIG. 11 shows, the cross-sectional shape of the initial section 38 is chosen to be as close as possible to the final shape; the upper section walls 45, 46 are curved outwards, the lower section wall 44 is straight and extended on one side by the above mentioned strut 41.

After bending, the component in question is introduced into the HIPF shaping tool 10*a*. By increasing the internal pressure, first the three section flanges or walls 44, 45, 46 come to rest on the wall contour 15. The corners with smaller radii are at first not changed in shape. On increasing the internal pressure further, the corner regions 48 are shape-formed. As a result of the friction between the tool 10*a* and the part 16, the tensile deformation in the direction of the periphery of the section which is necessary for filling out the corners is restricted to the section corners 48 and the surrounding regions. Because of the constant volume of aluminum under plastic deformation, that deformation results in internal tensile stresses at the corners 48 in the longitudinal direction. The resulting moment referring to the main axis of bending A does not disappear as the internal tensile forces are mainly on the right side. On removing the part 38 from the tool 10*a* there is therefore elastic spring-back which, after the HIPF process causes the section frame 40 to exhibit a smaller curvature than that prescribed by the contour 15 of the tool wall. The required tolerance can therefore not be met.

The spring-back effects described above can be counteracted by designing the initial section $\mathbf{38}_n$ as in FIG. 12. In order to achieve this, the moment around the main bending axis A caused by the internal stresses must be reduced or eliminated i.e. to the right of this main bending axis A one must induce mainly internal compressive forces instead of internal tensile forces or, left of the main bending axis one must induce mainly internal tensile forces. This is achieved by means of the cross-section of the initial section $\mathbf{38}_n$ shown in FIG. 12 due to the following methods of design:

The length of arc of the upper section wall $\mathbf{46}_n$ remote from the strut is oversized with respect to the final contour with the result that in the HIPF process compression in the direction of the periphery occurs at this place and, as a consequence thereof, the desired internal compressive forces are induced in the longitudinal direction; the oversizing is in the form of doming towards the interior, in order to prevent deformation on closing the tool $\mathbf{10}_a$.

The upper section wall $\mathbf{45}_n$ close to the strut is undersized with respect to the final contour with the result that in the HIPF process stretching of the material occurs at this place in the direction of the periphery and, as a consequence thereof, the desired internal tensile forces are induced in the longitudinal direction.

The base wall $\mathbf{44}_n$ is—as viewed in cross-section—domed from the corner regions 48, this—as shown in FIG. 6 for a triangular section—in order to simplify the shape-forming of the corners $\mathbf{48}_n$.

In the HIPF process this initial section $\mathbf{38}_n$—in contrast to the state of the art design—the corner regions $\mathbf{48}_n$ come to rest first on the tool contour 15. As a result of friction, the corner regions $\mathbf{48}_n$ of the part 38, adhere to the tool. With the small wall thickness b normally used in HIPF applications even under good lubrication conditions ($\mu$<0.05) most of the section surface adheres to the tool under tensile load.

On increasing the pressure further, the section walls $\mathbf{44}_n$, $\mathbf{45}_n$, $\mathbf{46}_n$, come to rest against the tool contour by plastically deforming, whereby the desired internal stresses are induced in the longitudinal direction of the section in order to prevent spring-back. The final section $\mathbf{50}_n$ produced this way is indicated in FIG. 10 by only part of the contour.

The section 52 shown schematically in FIG. 14 is intended to show—as already mentioned—that the procedure described is not limited to triangular-shaped cross-sections. The double chamber section 52 exhibits on the left of a central wall 54 a chamber 56 with—between a base strip 57 and the central wall 54—a curved side wall 59 and a chamber 60 on the right featuring a side wall 62, which runs from a roof strip 61 that runs parallel to and a distance from the base strip 57 and is made up of two lengths $\mathbf{62}_a$, $\mathbf{62}_b$ that are inclined at angle to each other. This double-chamber section 52 feature four right angled comer regions 58. The curved regions in the walls 54, 57, 59, 61, 62 of the initial section are not shown in the drawing.

What is claimed is:

1. A process for forming an initial section having a hollow interior to a final shape by means of high internal pressure in the sealed hollow interior using a flowable medium, the process comprising the steps of:

preshaping wall sections adjacent to a corner region of the initial section in a curved manner—as viewed in cross-section—counter to a direction of applied pressure in order to shape-form the initial section; and subsequently reshaping the wall sections by applying the high internal pressure of the flowable medium and displacing the corner region in a direction in which the pressure is applied so that first the corner region of the initial section is pushed against a contour of a wall of a shape-giving space, and subsequently, by increasing pressure, the section walls are pushed against the wall of the shape-giving space and plastically deformed.

2. A process according to claim 1, including, for forming an initial section featuring at least two corner regions, preshaping wall lengths running between the corner regions in a curved manner—as viewed in cross-section—counter to the direction of applied pressure, and subsequently reshaping the wall sections by applying the high internal pressure of the flowable medium and displacing the corner regions in the direction in which the pressure is applied.

3. A process according to claim 1, wherein a corner angle of the corner region is about 90°.

4. A process according to claim 1, wherein a corner angle of the corner region is less than 90°.

5. A process according to claim 4, wherein the corner region forms a peak.

6. A process according to claim 1, further including performing a displacement of the corner region in a direction of a middle line of the corner region.

7. A process according to claim 1, including creating a local degree of deformation of the initial section as oversizing with respect to a final contour of a final section by means of a dome-like, inwardly pointing curvature of the section cross-section.

8. A process according to claim 7, including creating compression, by HIPF-forming, toward a periphery of the section and thereby inducing compressive internal stresses.

9. A process according to claim 1, including creating a local degree of deformation of the initial section as undersizing with respect to a final contour of a final section.

10. A process according to claim 9, including stretching, during HIPF-forming, the section material toward a periphery of the section thereby inducing tensile internal stresses.

11. A process according to claim 1, wherein the corner region in the initial section is thickened.

12. A process according to claim 11, including shaping the wall section in the regions adjacent to the corner region with a cross-section that curves inwards.

13. A process according to claim 12, including shaping the wall section in the regions adjacent to the corner regions with a cross-section that curves inwards relative to a final cross-section.

14. A process according to claim 1, including shaping the section wall of the initial section at least with one region which is curved in cross-section as part of a circle or part of an ellipse.

15. A process according to claim 1, including shaping the section wall of the initial section at least with one region which, in cross-section, is curved as a parabola, hyperbola-like or similar shape.

* * * * *